US006598673B1

(12) United States Patent
Hosie et al.

(10) Patent No.: US 6,598,673 B1
(45) Date of Patent: Jul. 29, 2003

(54) WELLHEAD LOAD RING

(75) Inventors: Stanley Hosie, Peterhead (GB); Marc Minassian, LaPorte, TX (US); Norman Brammer, Aberdeen (GB)

(73) Assignee: ABB Vetco Gray Inc., Houston, TX (US)

( * ) Notice: Subject to any disclaimer, the term of this patent is extended or adjusted under 35 U.S.C. 154(b) by 60 days.

(21) Appl. No.: 09/689,489

(22) Filed: Oct. 12, 2000

Related U.S. Application Data

(60) Provisional application No. 60/158,768, filed on Oct. 12, 1999.

(51) Int. Cl.[7] ..... E21B 43/010

(52) U.S. Cl. ..... 166/208; 166/348; 166/75.14; 166/237

(58) Field of Search ..... 166/348, 368, 166/338, 208, 75.14, 237, 77.51; 403/368, 372

(56) References Cited

U.S. PATENT DOCUMENTS

| | | | | | |
|---|---|---|---|---|---|
| 3,334,923 | A | * | 8/1967 | Putch | 166/348 |
| 3,454,289 | A | * | 7/1969 | Fowler | 166/348 |
| 3,693,714 | A | * | 9/1972 | Baugh | 166/348 |
| 3,845,815 | A | * | 11/1974 | Garwood | 166/154 |
| 3,937,279 | A | | 2/1976 | Raulins | 166/214 |
| 4,295,665 | A | * | 10/1981 | Pierce | 285/123.2 |
| 4,362,211 | A | * | 12/1982 | Fisher, Jr. | 166/156 |
| 4,460,042 | A | | 7/1984 | Galle, Jr. | |
| 4,469,179 | A | * | 9/1984 | Crow et al. | 166/319 |
| 4,496,162 | A | * | 1/1985 | McEver et al. | 166/123 |
| 4,528,738 | A | | 7/1985 | Galle, Jr. | |
| 4,574,883 | A | | 3/1986 | Carroll et al. | 166/255 |
| 4,651,830 | A | * | 3/1987 | Crotwell | 166/217 |
| 4,982,795 | A | * | 1/1991 | King | 166/208 |
| 5,066,048 | A | * | 11/1991 | Farrell | 285/123.4 |
| 6,125,939 | A | | 10/2000 | Abreo, Jr. | |

FOREIGN PATENT DOCUMENTS

| | | |
|---|---|---|
| GB | 2339582 | 2/2000 |

OTHER PUBLICATIONS

Composite Catalog 1978–1979, 33rd Revision, Cameron mudline suspension system, 3 pages.

* cited by examiner

*Primary Examiner*—David Bagnell
*Assistant Examiner*—John Kreck
(74) *Attorney, Agent, or Firm*—Bracewell & Patterson, L.L.P.

(57) ABSTRACT

A wellhead load ring constructed in the shape of a C-ring is pre-installed in a wellhead in a storage position that maintains full bore of the wellhead. The load ring is secured in this position by shear pins. The shear pins are sheared by a tool that pushes the load ring into an operational position where it rests on a landing shoulder of a support ring. The load ring is further secured in this position by one of several latching methods.

8 Claims, 6 Drawing Sheets

WELLHEAD LOAD RING

This application claims the benefit of U.S. Provisional Application No. 60/158,768, filed Oct. 12, 1999.

BACKGROUND OF THE INVENTION

1. Field of the Invention

The present invention relates generally to well casing hangers in petroleum production wells. More specifically, the present invention relates to a full bore wellhead having a retractable load shoulder for suspending a casing.

2. Description of the Related Art

In some types of wellhead assemblies casing is suspended by a casing hanger on a load shoulder formed in the bore of the wellhead housing. Generally the load shoulder is formed integrally or permanently attached to the wellhead housing. The fixed load shoulder results in a reduced diameter in the bore below the load shoulder. Any tools or pipe must be smaller than the fixed shoulder. In some wells, more than one load shoulder is utilized for supporting multiple strings of casing.

Retrievable load shoulders are also known in the art, employing a running tool to deploy and retrieve the load shoulder selectively. Also, the prior art includes retractable load shoulders that are installed with the wellhead housing, but retracted before running casing. Retrievable and retractable load shoulders provide full bore access.

BRIEF SUMMARY OF THE INVENTION

A wellhead load ring constructed in the shape of a C-ring is pre-installed in a wellhead in a storage position that maintains full bore of the wellhead. The load ring is preferably secured in this position by shear pins. The shear pins are sheared by a tool that pushes the load ring into an operational position, where it rests on a landing shoulder of a support ring. The load ring is further secured in this position by one of several latching methods.

DETAILED DESCRIPTION OF THE PREFERRED EMBODIMENT

Figure 1:
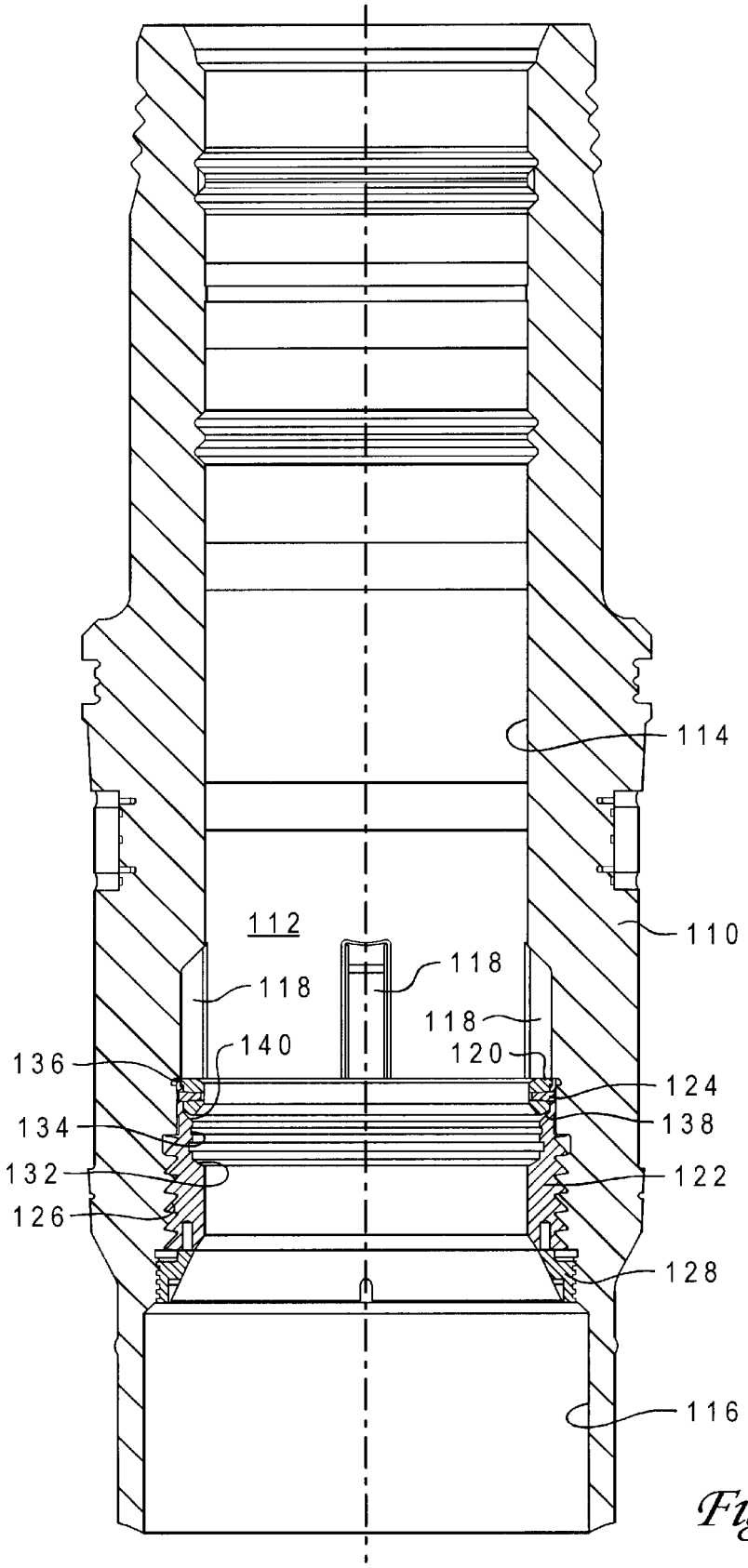
FIG. 1 is a vertical cross-sectional view of an upper and lower portion of a wellhead housing showing a load shoulder ring in a storage position in accordance with the principles of the invention described herein.
Figure 3:
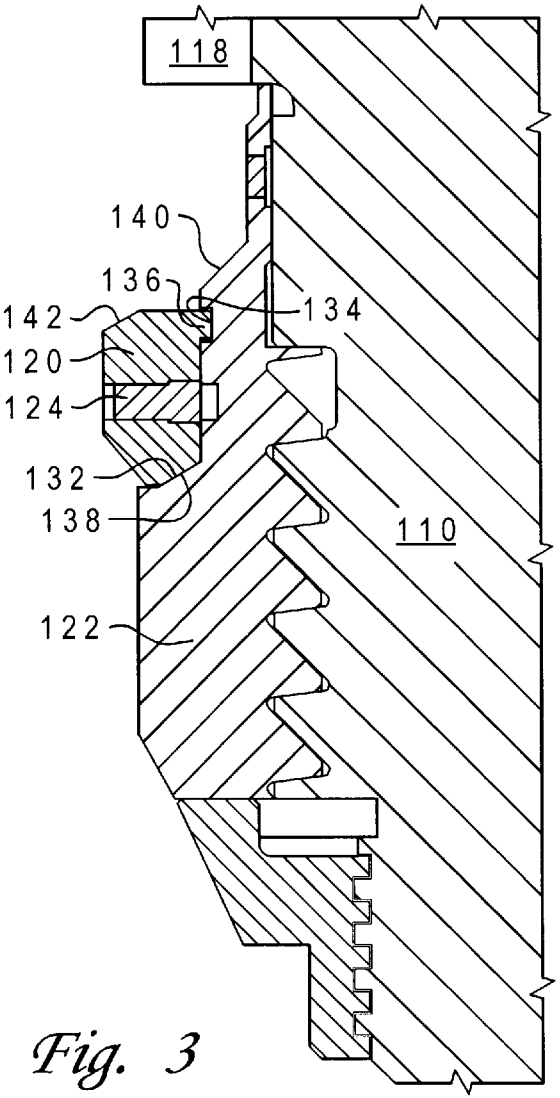
FIG. 3 is a vertical cross section of the load shoulder ring of FIG. 2, but showing the load shoulder ring in an operational position in accordance with the principles of the invention described herein.

Referring to FIG. 1, wellhead housing 110 has an axial bore 112. Axial bore 112 has upper portion 114 and a lower portion 116, which is an upper portion of a large diameter string of casing. Upper portion 114 has a constant inner diameter and is considered full bore for the purpose of receiving tools and casing during drilling. Lower portion 116 has a diameter larger than upper portion 114, therefore no portion of bore 112 is less than full bore. Four circumferentially spaced cavities 118 are located at the lower end of the upper portion 114 of axial bore 112. Cavities 118 are adapted to receive a tool (not shown) as explained later.

Figure 2:
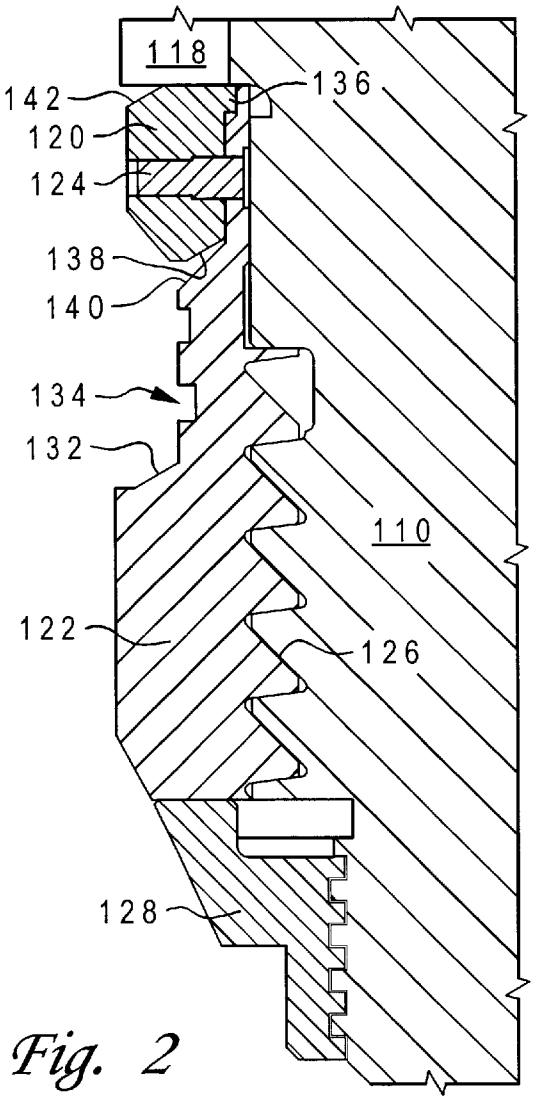
FIG. 2 an enlarged vertical cross section of the wellhead housing shown in FIG. 1, showing the load shoulder ring in a storage position in accordance with the principles of the invention described herein.

A split C-ring 120 is located in bore 112 immediately below cavities 118. C-ring 120 is initially secured to a support ring 122 by a plurality of shear pins 124. C-ring 120 is in its free state while in this position, and its inner diameter is greater than or equal to the main diameter of bore upper portion 114. Support ring 122 is statically secured to bore 112 by means of external threads 126 and by resting on lock ring 128. Support ring 122 has mating shear holes 130 for receiving shear pins 124. Shear pins 124 are designed to fail at a predetermined load, at which time the resiliency C-ring 1 20 allows it to contract to a smaller inner diameter. FIG. 1 and FIG. 2 show C-ring 120 in a storage position. Support ring 122 has an internal upward facing shoulder 132 and a profile 134 on its inward facing surface that mates with an outward facing lip or protrusion 136 on the upper end of C-ring 120, when in the operational position. The inner diameter of support ring 122 is not less than the inner diameter of bore upper portion 114.

During operation, wellhead housing 110 is installed within a previously installed tubular wellhead on the subsea surface. Casing 116 extends into the well from wellhead housing 110. When it is desired to install casing within casing 116, C-ring 120 is moved to the operational position by a tool (not shown) lowered from above. The tool will preferably be simultaneously running the casing. The tool has fingers that protrude outward and locate in cavities 118 and engages C-ring 120. The tool is moved downward to shear pins 124 and push C-ring 120 downward. As C-ring 120 moves downward, outward facing wedging surface 138 mates with inward facing wedging surface 140 to force C-ring 120 to a smaller diameter so that it can land on landing shoulder 132. The smaller inner diameter provides an upward facing load shoulder 142 which is used to hang the additional casing string. As C-ring 120 rests on landing shoulder 132, protrusion 136 mates with profile 134 to secure C-ring 120 to support ring 122.

Figure 4:
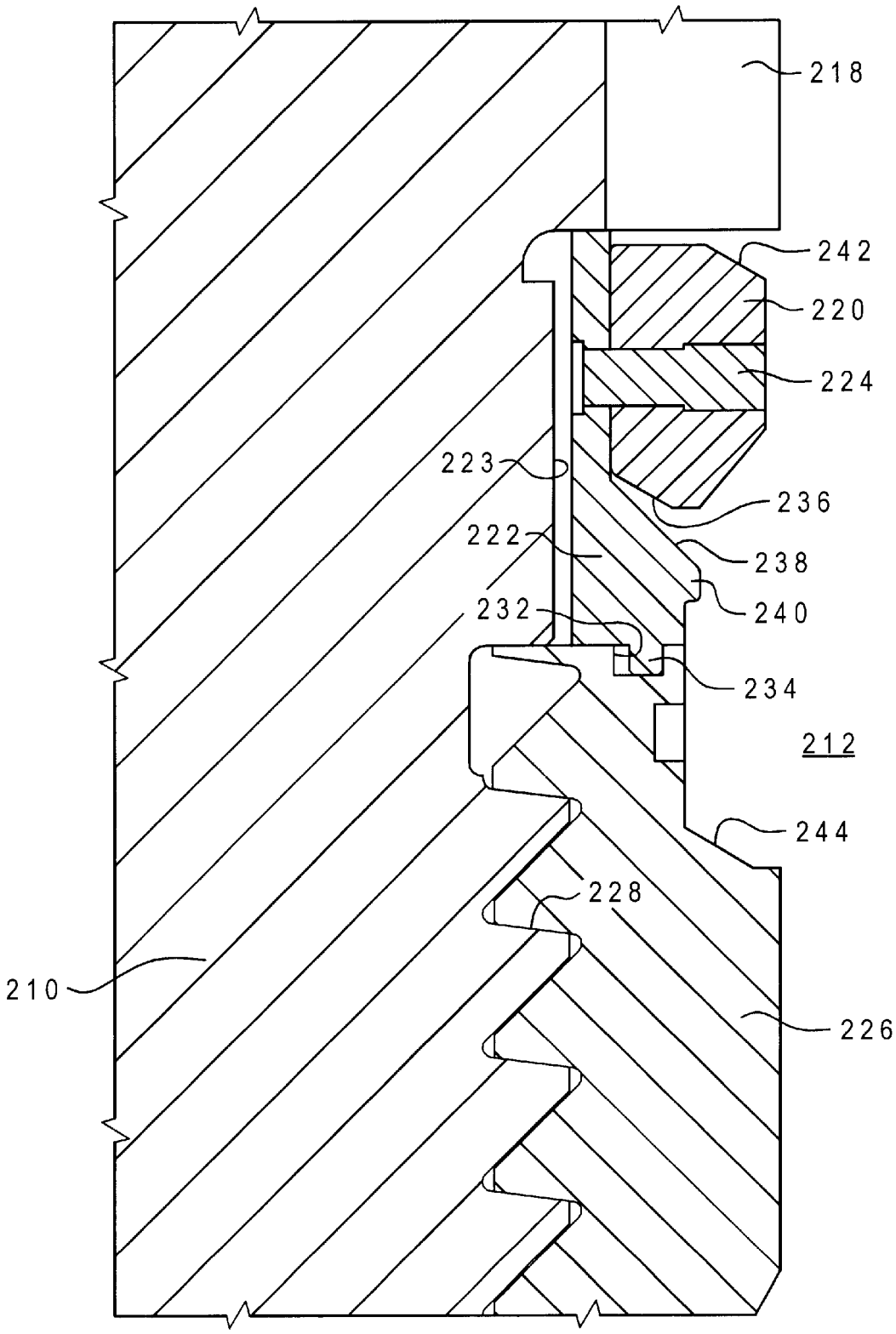
FIG. 4 is a vertical cross-sectional view of a second embodiment of the invention, showing a load shoulder ring in a storage position in accordance with the principles of the invention described herein.
Figure 5:
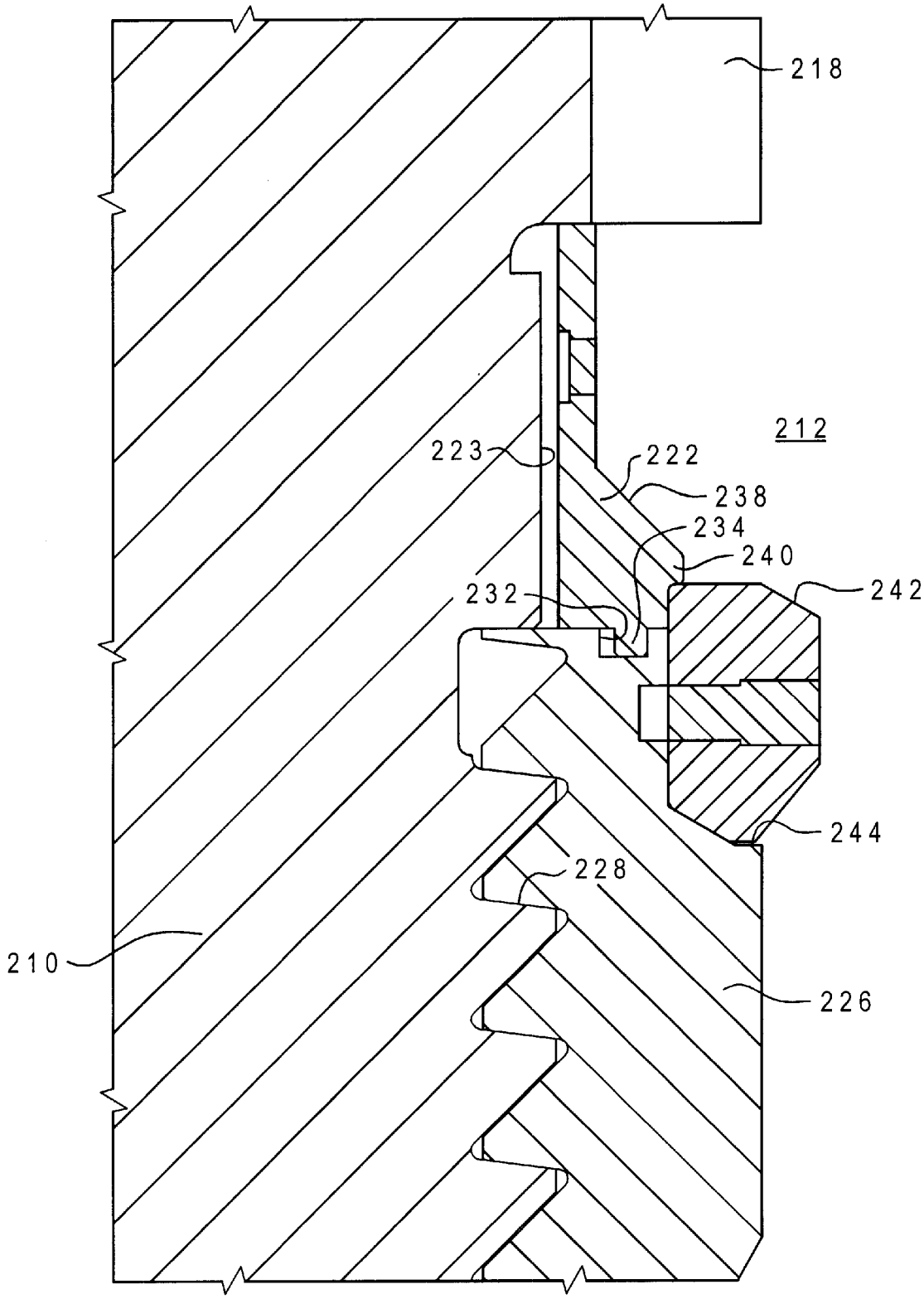
FIG. 5 is a vertical cross-sectional view of the load shoulder ring of FIG. 4, but showing the load shoulder ring in an operational position in accordance with the principles of the invention described herein.

FIGS. 4 and 5 show a second embodiment of the present invention. Referring to FIG. 4, wellhead housing 210 has an axial bore 212. Four circumferentially spaced cavities 218 are located in axial bore 212. Cavities 218 are adapted to receive a tool (not shown) as explained later.

A load shoulder split C-ring 220 and spring split C-ring 222 are located immediately below cavities 218. C-rings 220, 222 respectively, are pre-installed in wellhead 210 as shown in FIG. 4 such that the axial bore 212 remains full bore. Load shoulder split C-ring 220 is located inside spring split C-ring 222 when in a storage position such that the inner diameter of C-rings 220, 222 in the storage position are not less than full bore. Spring split C-ring 222 locates in a groove 223 in bore 212. Shear pins 224 extend through load shoulder split C-ring 220 to secure it to spring split C-ring 222. Spring split C-ring 222 is located on top of a support ring 226. Support ring 226 is secured to the wellhead housing by external threads 228, and further supported by a lock ring (not shown). Support ring 226 has a recess 232 on it upper surface that receives a rib 234 on the lower surface of spring split C-ring 222. As shown in FIG. 4, spring split C-ring 222 is positioned between upper portion 214 and support ring 226 such that rib 234 and recess 232 retain spring split C-ring 222 to the wellhead housing 210, but allow radial movement.

Load shoulder split C-ring has an outward facing wedging surface 236 on it lower end. Spring split C-ring 222 has a matching inward facing wedging surface 238 below load shoulder split C-rings storage position. Spring split C-ring has a lip 240 below inward facing wedging surface 238. Load shoulder split C-ring has an upward facing load shoulder 242 on its upper end.

During operation, the wellhead housing 210 is installed in a wellhead previously installed on the subsea surface. When it is desired to install casing within wellhead housing 210 , load shoulder C-ring 220 is moved to the operational position by a tool (not shown) lowered from above. The tool, which preferably is simultaneously running the casing, locates in cavities 218 and engages load shoulder C-ring 220. The tool is moved downward to shear pins 224 and push load shoulder C-ring 220 downward. As load shoulder C-ring 220 moves downward, outward facing wedging surface 236 mates with inward facing wedging surface 238 to force load shoulder C-ring 220 to a smaller diameter and spring split C-ring 222 to a slightly larger diameter, allowing load shoulder split C-ring 220 to pass lip 240 on spring split C-ring 222. Once pass lip 240, the smaller inner diameter of load shoulder split C-ring 220 provides an upward facing load shoulder 242 which may be used to hang additional casing string. As C-ring 220 rests on landing shoulder 244, lip 240 overlaps the top of load shoulder C-ring 220 slightly to secure load shoulder C-ring 220 to support ring 226. FIG. 5 shows load shoulder C-ring 220 in an operational position, resting on landing shoulder 244 and secured by lip 240.

Figure 6:
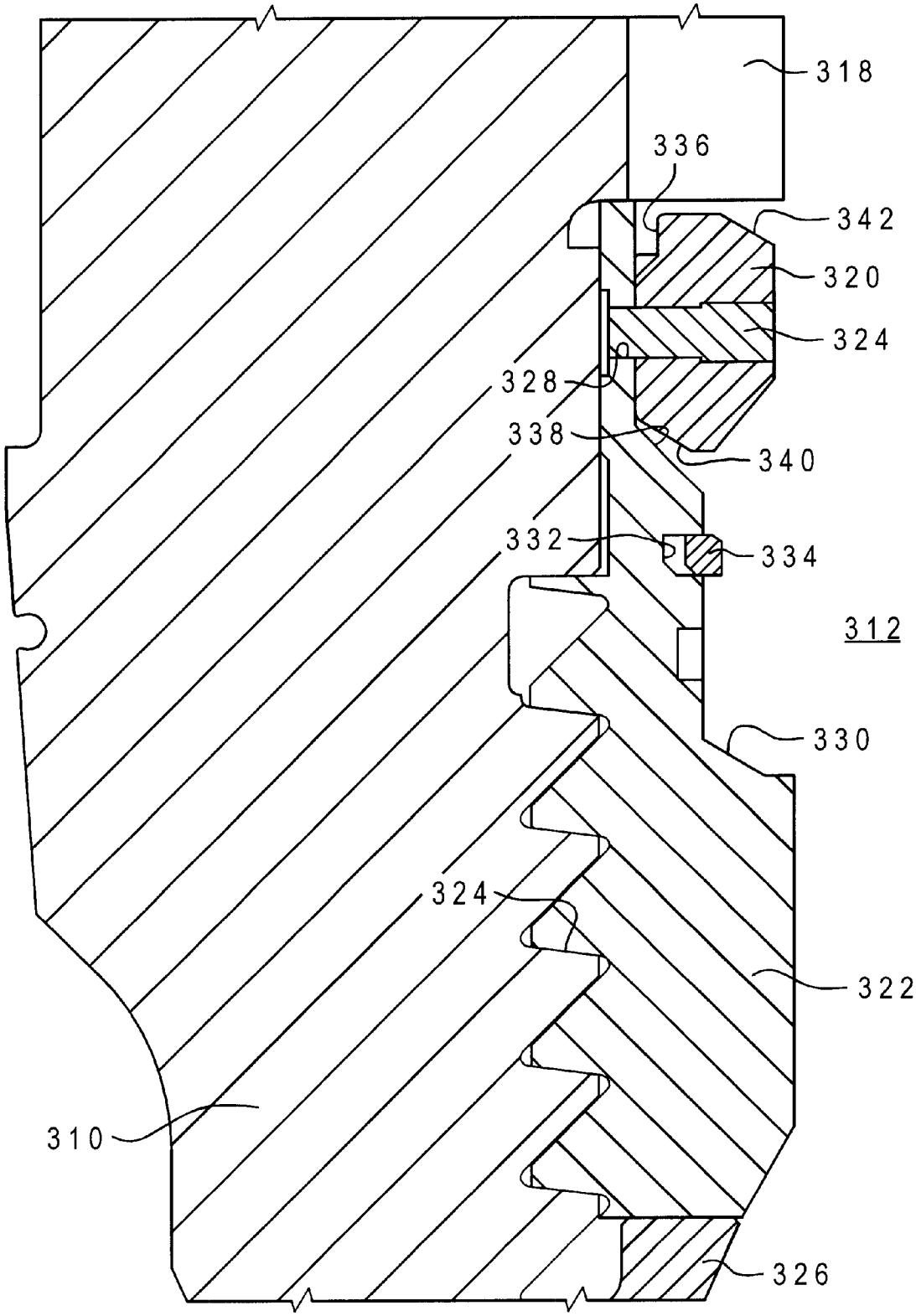
FIG. 6 is a vertical cross-sectional view of a third embodiment of the invention, showing a load shoulder ring in a storage position in accordance with the principles of the invention described herein.
Figure 7:
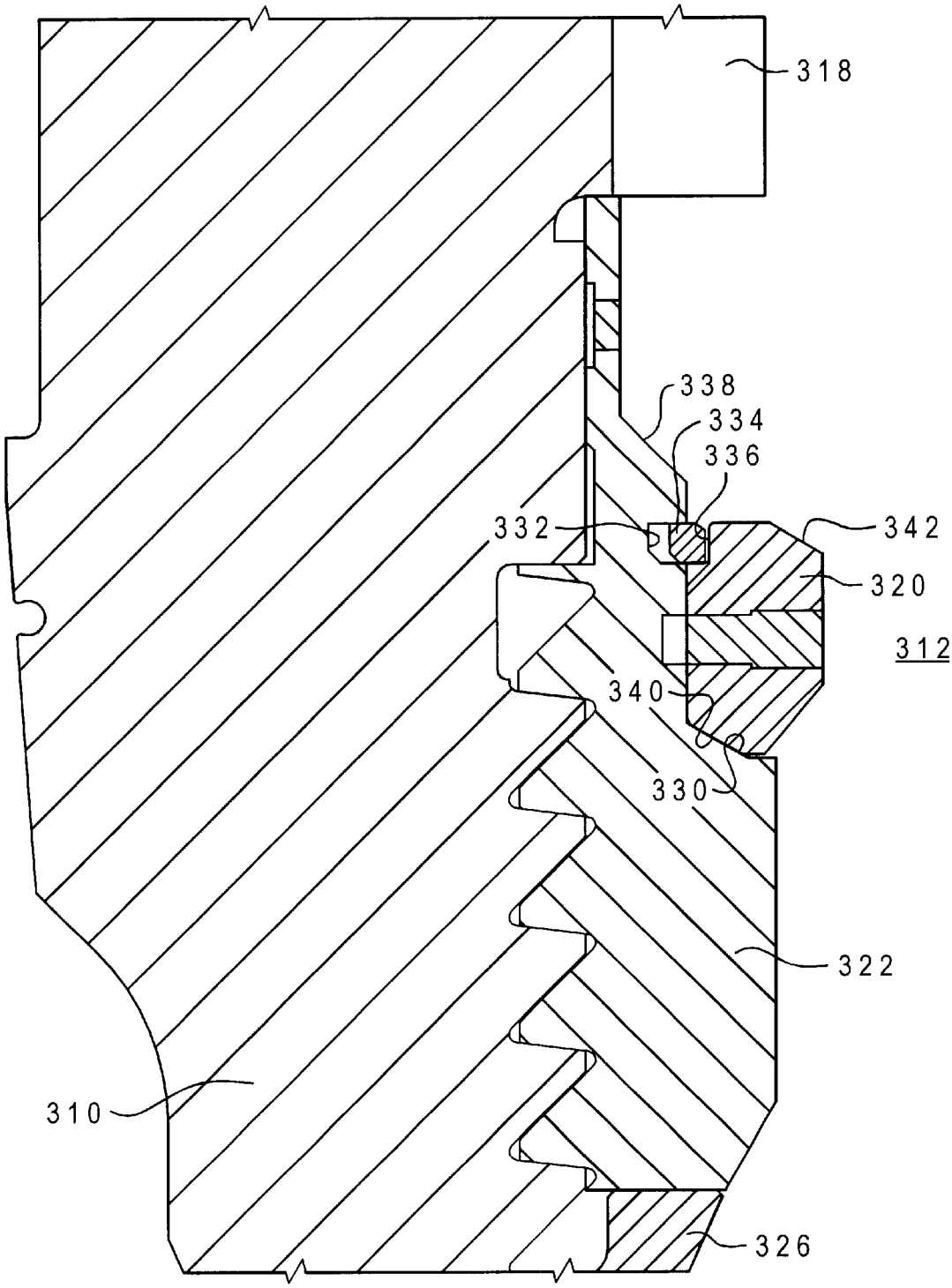
FIG. 7 is a vertical cross-sectional view of the load shoulder ring of FIG. 6, but showing the load shoulder ring in an operational position in accordance with the principles of the invention described herein.

FIGS. 6 and 7 show yet another embodiment of the present invention. Referring to FIG.6, wellhead housing 310 has an axial bore 312. Four circumferentially spaced cavities 318 are located in axial bore 312. Cavities 318 are adapted to receive a tool (not shown) as explained later.

A split C-ring 320 is located in bore 312 immediately below cavities 318. A C-ring 320 is initially secured to a support ring 322 by a plurality of shear pins 324. C-ring 320 is in its free state while in this position, and its inner diameter is greater than or equal to the main diameter of bore upper portion 314. A support ring 322 is statically secured to bore lower portion 316 by means of external threads 324 and resting on lock ring 326. Support ring 322 has mating shear holes 328 for receiving shear pins 324. Shear pins 324 are designed to fail at a predetermined load, at which time the resiliency C-ring 320 allows it to contract to a smaller inner diameter. FIG. 6 shows C-ring 320 in a storage position. Support ring 322 has an internal upward facing shoulder 330. Support ring 322has a recess 332 on its inward facing surface that mates with a retainer ring 334. Retainer ring 334 is located so that it aligns with a seat or notch 336 on the upper end of C-ring 320 when in the operational position. The inner diameter of support ring 322 is not less than the inner diameter of bore upper portion 314.

During operation, the wellhead housing 310 is installed in a wellhead on the subsea surface. When it is desired to install casing within wellhead housing 310, C-ring 320 is moved to the operational position by a tool (not shown) lowered from above. The tool locates in cavities 318 and engages C-ring 320. The tool is moved downward to shear pins 324 and push C-ring 320 downward. As C-ring 320 moves downward, outward facing wedging surface 338 mates with inward facing wedging surface 340 to force C-ring 320 to a smaller diameter so that it can land on landing shoulder 330. The smaller inner diameter provides as an upward facing load shoulder 342 which is used to hang an additional casing string. As C-ring 320 comes to rest on landing shoulder 330, retainer ring 334 snaps into notch 336 securing C-ring.

The embodiments described above all provide the same advantages. The load shoulders are fully retracted when in the storage position. This allows full bore tools to pass. The design also allows the shoulder operation to be performed simultaneously with running the casing or separately so that the shoulder may be tested prior to running the casing.

While the invention has been shown in only some of its forms, it should be apparent to those skilled in the art that it is not so limited, but is susceptible to various changes without departing from the scope of the invention.

We claim:

1. A wellhead assembly comprising:

a wellhead housing having an axial bore with a minimum inner diameter portion;

a support ring secured by threads to an enlarged portion of the bore of the wellhead housing below the minimum inner diameter portion, the support ring having a landing shoulder and a recessed upper portion extending above the landing shoulder; and a split ring with an inclined upward and inward facing load shoulder, the split ring being a resilient C-ring and movable between a storage position releasably secured to the recessed upper portion of the support ring to an operational position in contact with the landing shoulder; wherein the split ring has an inner diameter at least equal to the minimum inner diameter portion of the bore while in the storage position and an inner diameter less than the minimum inner diameter portion of the bore while in the operational position to support a casing hanger on the load shoulder.

2. The wellhead assembly of claim 1 wherein:

the split ring has a radially outward facing surface with a notch adjacent its upper end;

the support ring has an inward biased retainer ring located on its upper portion; and the retainer ring mates with the notch when the split ring is in the operational position to secure the split ring.

3. The wellhead assembly of claim 1, further comprising an inward biased retainer ring mounted to the upper portion of the support ring for engaging the split ring while the split ring is in the operational position.

4. A wellhead assembly comprising:

a wellhead housing having an axial bore with a minimum inner diameter portion;

a support ring secured by threads to an enlarged portion of the bore of the wellhead housing below the minimum inner diameter portion, the support ring having a landing shoulder and a recessed upper portion extending above the landing shoulder;

a split ring with an upward facing load shoulder, the split ring being movable between a storage position releasably secured to the recessed upper portion of the support ring to an operational position in contact with the landing shoulder; wherein the split ring has an inner diameter at least equal to the minimum inner diameter portion of the bore while in the storage position and an inner diameter less than the minimum inner diameter portion of the bore while in the operational position to support a casing hanger on the load shoulder;

the split ring has a radially outward facing surface with a lip protruding radially therefrom;

the support ring has a grooved profile on its upper portion; and the lip mates with the profile when the split ring is in the operational position to prevent axial movement of the split ring.

5. A wellhead assembly comprising:

a wellhead housing having an axial bore with a minimum inner diameter portion;

a support ring secured by threads to an enlarged portion of the bore of the wellhead housing below the minimum inner diameter portion, the support ring having a landing shoulder and a recessed upper portion extending above the landing shoulder;

a split ring with an upward facing load shoulder, the split ring being movable between a storage position releasably secured to the recessed upper portion of the support ring to an operational position in contact with the landing shoulder; wherein the split ring has an inner diameter at least equal to the minimum inner diameter portion of the bore while in the storage position and an inner diameter less than the minimum inner diameter portion of the bore while in the operational position to support a casing hanger on the load shoulder; and a lock ring secured to the wellhead housing to secure the support ring from its lower end.

6. A wellhead assembly comprising:

a wellhead housing having an axial bore with a minimum inner diameter portion;

a support ring secured by threads to an enlarged portion of the bore of the wellhead housing below the minimum inner diameter portion, the support ring having a landing shoulder and a recessed upper portion extending above the landing shoulder;

a split ring with an upward facing load shoulder, the split ring being movable between a storage position releasably secured to the recessed upper portion of the support ring to an operational position in contact with the landing shoulder; wherein the split ring has an inner diameter at least equal to the minimum inner diameter portion of the bore while in the storage position and an inner diameter less than the minimum inner diameter portion of the bore while in the operational position to support a casing hanger on the load shoulder; and the wellhead housing defines circumferentially spaced cavities for locating a tool that moves the load ring from the storage position to the operational position.

7. A wellhead assembly comprising:

a wellhead housing having an axial bore;

a support ring threadingly attached to the wellhead housing axial bore, having an upper portion of an increased inner diameter, an inward facing wedging surface and a lower section of reduced inner diameter with a landing shoulder and a grooved profile;

a split ring with an upward facing load shoulder and a radially outward protruding lip, the split ring being releasably secured in a storage position in the increased diameter portion of the support ring; and wherein the split ring is movable from the storage position to an operational position where the split ring rests on the landing shoulder in the reduced diameter section of the support ring, such that the upward facing load shoulder is of a smaller diameter than the bore, and the lip and the grooved profile mate to secure the split ring.

8. The wellhead assembly of claim 7 wherein:

the wellhead housing defines circumferentially spaced cavities in the bore for locating a tool that moves the load ring from the storage position to the operational position.

* * * * *

UNITED STATES PATENT AND TRADEMARK OFFICE

CERTIFICATE OF CORRECTION

PATENT NO. : 6,598,673 B1
DATED : July 29, 2003
INVENTOR(S) : Stanley Hosie et al.

It is certified that error appears in the above-identified patent and that said Letters Patent is hereby corrected as shown below:

Column 1,
Line 45, insert -- is -- before "an enlarged"

Column 2,
Line 44, delete "engages" and insert therefor -- engage --

Column 3,
Line 6, delete "it" and insert therefor -- its --
Line 33, delete "pass" and insert therefor -- past --

Signed and Sealed this

Thirtieth Day of September, 2003

JAMES E. ROGAN
*Director of the United States Patent and Trademark Office*